US012318000B2

(12) United States Patent
Chen et al.

(10) Patent No.: US 12,318,000 B2
(45) Date of Patent: Jun. 3, 2025

(54) SLIDE RAIL MECHANISM

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shih-Lung Huang, Kaohsiung (TW); Yi-Syuan Jhao, Kaohsiung (TW); Chun-Chiang Wang, Kaohsiung (TW)

(73) Assignees: KING SLIDE WORKS CO., LTD., Kaohsiung (TW); KING SLIDE TECHNOLOGY CO., LTD., Kaohsiung (TW)

( * ) Notice: Subject to any disclaimer, the term of this patent is extended or adjusted under 35 U.S.C. 154(b) by 248 days.

(21) Appl. No.: 18/198,267

(22) Filed: May 16, 2023

(65) Prior Publication Data

US 2024/0245212 A1 Jul. 25, 2024

(30) Foreign Application Priority Data

Jan. 19, 2023 (TW) ..... 112103213

(51) Int. Cl.
*A47B 88/447* (2017.01)
*A47B 88/443* (2017.01)
*A47B 88/919* (2017.01)

(52) U.S. Cl.
CPC ..... *A47B 88/447* (2017.01); *A47B 88/443* (2017.01); *A47B 88/919* (2017.01); *A47B 2210/0059* (2013.01)

(58) Field of Classification Search
CPC ..... A47B 88/447; A47B 88/919; A47B 2210/0059; A47B 88/443; E05B 65/46; E05B 65/461; E05B 65/462; E05B 65/463; E05B 65/464
See application file for complete search history.

(56) References Cited

U.S. PATENT DOCUMENTS 4,077,684 A 3/1978 Scherrer
4,303,288 A * 12/1981 Aschinger ..... E05B 65/462 312/220
5,931,548 A * 8/1999 Bischoff ..... E05B 65/463 312/217
5,988,778 A 11/1999 Lammens
6,296,332 B1 10/2001 Lammes
6,550,876 B2 4/2003 Lammens
(Continued)

FOREIGN PATENT DOCUMENTS

DE 25 48 373 A1 4/1977
JP 49-85341 U 7/1974
(Continued)

*Primary Examiner* — Hiwot E Tefera
(74) *Attorney, Agent, or Firm* — Winston Hsu

(57) ABSTRACT

A slide rail mechanism is configured to a cabinet. The cabinet includes a wall with a first side and a second side opposite to the first side. The slide rail mechanism includes a first slide rail assembly, a second slide rail assembly and a working member. When a second rail of the first slide rail assembly is opened with respect to a first rail, the second rail is able to drive the working member for preventing a fourth rail of the second slide rail assembly to be opened with respect to a third rail.

13 Claims, 12 Drawing Sheets

(56) References Cited

U.S. PATENT DOCUMENTS

| | | | | |
|---|---|---|---|---|
| 7,144,092 | B1 * | 12/2006 | Chang | E05B 65/462 312/217 |
| 7,320,507 | B2 | 1/2008 | White | |
| 7,823,992 | B2 | 11/2010 | Chen | |
| 9,788,653 | B1 * | 10/2017 | Lazenby | A47B 81/00 |
| 2005/0040739 | A1 * | 2/2005 | White | E05B 65/464 312/217 |
| 2007/0040484 | A1 * | 2/2007 | Huang | E05B 65/464 312/221 |
| 2008/0061663 | A1 * | 3/2008 | Wu | E05B 65/463 312/333 |
| 2008/0074017 | A1 * | 3/2008 | Ruan | E05B 65/464 312/215 |
| 2009/0212670 | A1 * | 8/2009 | Bustle | A61G 12/001 312/333 |
| 2010/0148648 | A1 | 6/2010 | Green | |
| 2021/0230913 | A1 * | 7/2021 | Dukeshire | E05B 65/44 |

FOREIGN PATENT DOCUMENTS

| | | | |
|---|---|---|---|
| JP | 54-38866 | | 3/1979 |
| JP | 6-154053 | A | 6/1994 |
| JP | 7-298938 | A | 11/1995 |
| JP | 2000-282736 | A | 10/2000 |
| JP | 2000-291307 | A | 10/2000 |
| JP | 2019-132104 | A | 8/2019 |

* cited by examiner

SLIDE RAIL MECHANISM

BACKGROUND OF THE INVENTION

1. Field of the Invention

The present invention relates to a slide rail system, and more particularly, to a slide rail mechanism including a plurality of slide rail assemblies and only pulling open one of the slide rail assemblies in each operation.

2. Description of the Prior Art

U.S. Pat. No. 7,520,576B2 discloses an anti-tilt linkage mechanism that is applied for a vertical cabinet with several movable drawers. The vertical cabinet includes a file cabinet body, telescopic slide rails and two or more drawers. The telescopic slide rails are installed on the inner wall of the file cabinet body. The drawers are vertically installed inside the file cabinet body via the telescopic slide rails; when one drawer is pulled open, the other drawers cannot be pulled out from the file cabinet body.

However, the linkage mechanism of the foresaid patent is only suitable for two or more slide rails (or the related drawers) that are installed in a vertical manner. Design of a linkage product of satisfying market competition and different operation demands is an important issue in the institutional design industry.

SUMMARY OF THE INVENTION

The present invention provides a slide rail mechanism including a plurality of slide rail assemblies and only pulling open one of the slide rail assemblies in each operation for solving above drawbacks.

According to the claimed invention, a slide rail mechanism is configured to a cabinet, and the cabinet has a wall with a first side and a second side opposite to each other. The slide rail mechanism includes a first slide rail assembly, a second slide rail assembly and a working member. The first slide rail assembly is arranged on the first side of the wall. The first slide rail assembly includes a first rail and a second rail, and the second rail is shifted with respect to the first rail in a longitudinal direction. The second slide rail assembly is arranged on the second side of the wall. The second slide rail assembly includes a third rail and a fourth rail. The fourth rail is shifted with respect to the third rail in the longitudinal direction. The working member is movably mounted on the wall. The second rail is configured to move back into the first rail of the first slide rail assembly, and the fourth rail is configured to move back into the third rail of the second slide rail assembly. When the second rail is shifted with respect to the first rail of the first slide rail assembly in an actuation direction, the working member is driven by the second rail to switch from a first mode to a second mode, so as to prevent the fourth rail from being shifted with respect to the third rail of the second slide rail assembly in the actuation direction.

According to another claimed invention, a slide rail mechanism is configured to a wall with a first side and a second side opposite to each other. The slide rail mechanism includes a first slide rail assembly, a second slide rail assembly and a working member. The first slide rail assembly is arranged on the first side of the wall. The first slide rail assembly includes a first rail and a second rail. The second rail is shifted with respect to the first rail in a longitudinal direction. The second slide rail assembly is arranged on the second side of the wall. The second slide rail assembly includes a third rail and a fourth rail. The fourth rail is shifted with respect to the third rail in the longitudinal direction. The working member movably mounted on the wall. When the second rail is shifted with respect to the first rail of the first slide rail assembly in an actuation direction, the working member is driven by the second rail to switch from a first mode to a second mode, so as to prevent the fourth rail from being shifted with respect to the third rail of the second slide rail assembly in the actuation direction. The slide rail mechanism further comprises a third slide rail assembly arranged on the first side of the wall, the third slide rail assembly comprises a fifth rail and a sixth rail, and the sixth rail is shifted with respect to the fifth rail in the longitudinal direction. When the second rail is shifted with respect to the first rail of the first slide rail assembly in the actuation direction, the sixth rail is blocked by a linkage mechanism to prevent the sixth rail from being shifted with respect to the fifth rail of the third slide rail assembly in the actuation direction.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
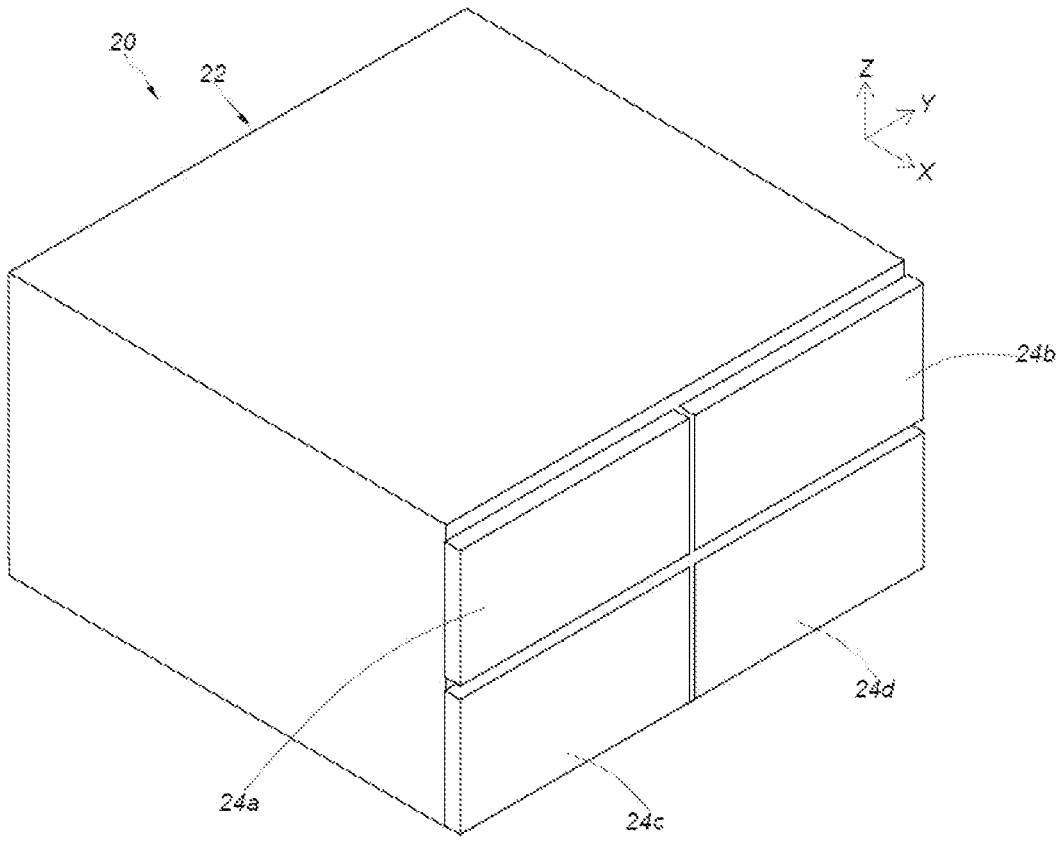
FIG. 1 is a diagram of furniture with a cabinet and a plurality of drawers according to an embodiment of the present application.

Please refer to FIG. 1. In the embodiment of the present application, furniture 20 can include a cabinet 22, and the cabinet 22 can have a plurality of drawers; for example, the cabinet 22 can at least include a first drawer 24*a* and a second drawer 24*b*, and may preferably further include a third drawer 24*c* and a fourth drawer 24*d*. The plurality of drawers can be accommodated inside the cabinet 22. The first drawer 24*a* and the second drawer 24*b* can be set as a first transverse row (or can be defined as a first lateral row). The third drawer 24*c* and the fourth drawer 24*d* can be set as a second transverse row (or can be defined as a second lateral row). The first drawer 24*a* and the third drawer 24*c* can be set as a first upright row. The second drawer 24*b* and the fourth drawer 24*d* can be set as a second upright row.

Figure 2:
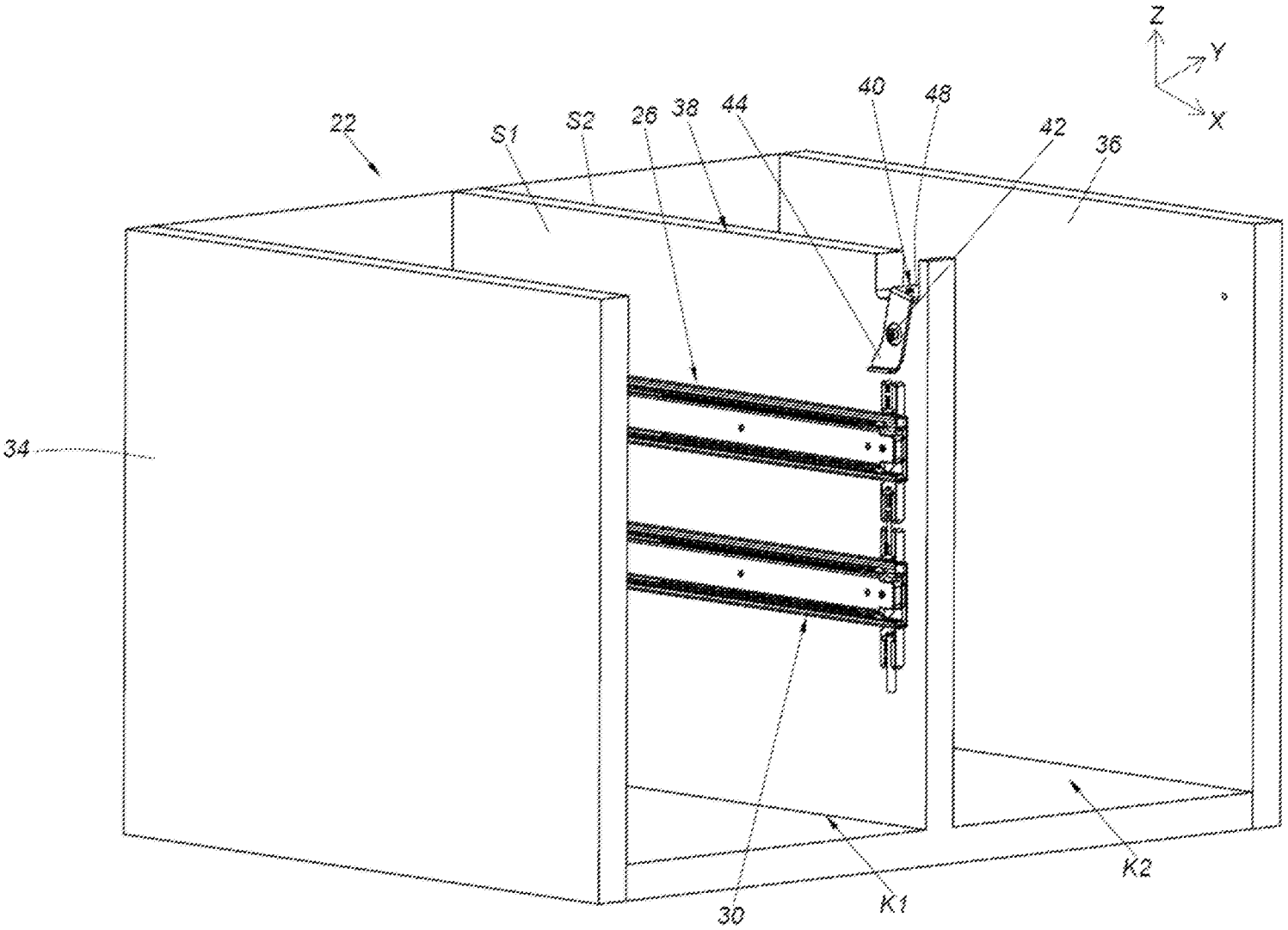
FIG. 2 is a diagram of a plurality of slide rail assemblies arranged on a first side of a wall of the cabinet according to the embodiment of the present application.
Figure 3:
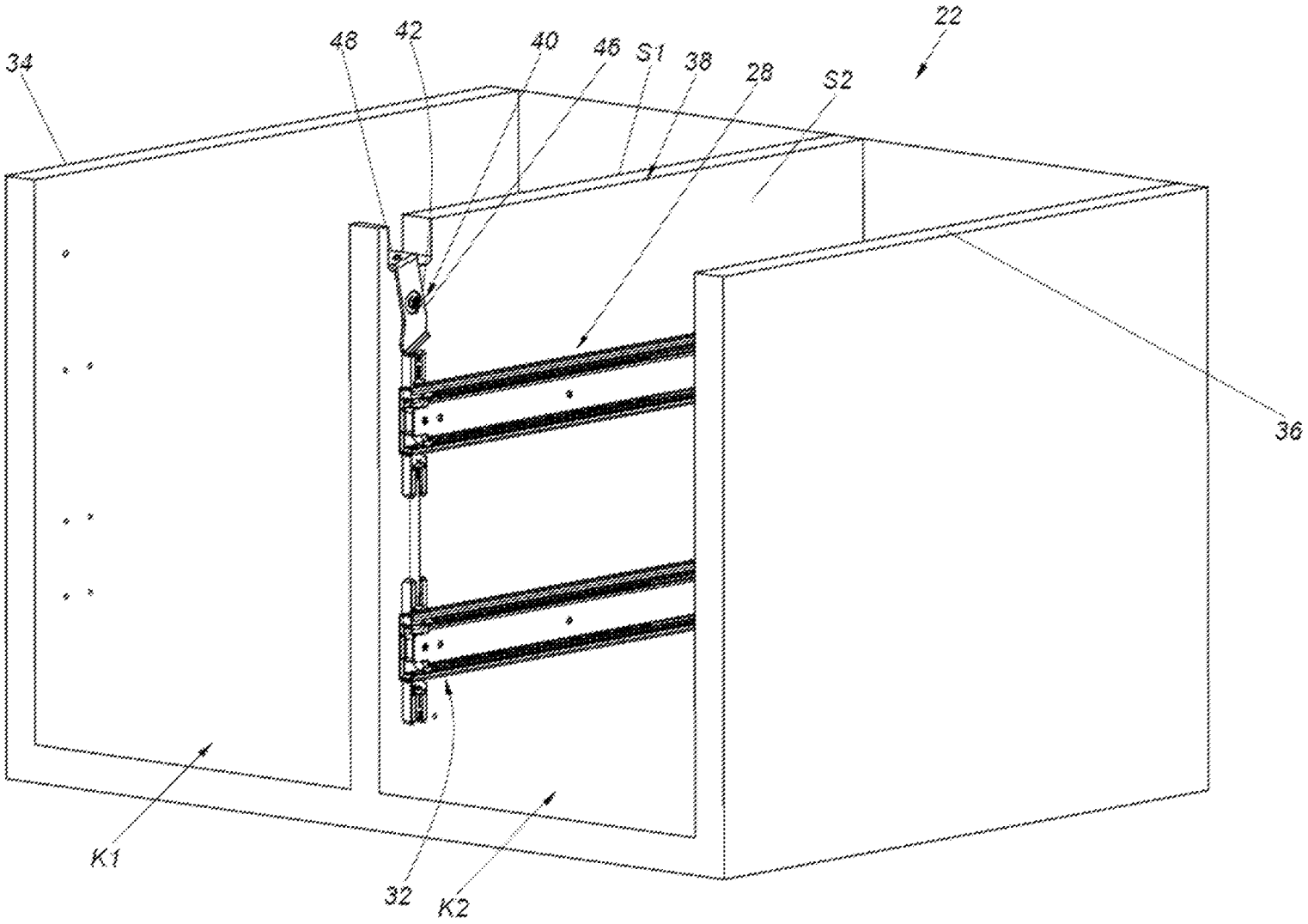
FIG. 3 is a diagram of a plurality of slide rail assemblies arranged on a second side of a wall of the cabinet according to the embodiment of the present application.

Please refer to FIG. 2 and FIG. 3. The cabinet 22 can include a slide rail mechanism, and the slide rail mechanism can include a plurality of slide rail assemblies, such as a first slide rail assembly 26, a second slide rail assembly 28, a third slide rail assembly 30 and a fourth slide rail assembly 32 respectively configured to hold the first drawer 24*a*, the second drawer 24*b*, the third drawer 24*c* and the fourth drawer 24*d*. Each of the first slide rail assembly 26, the second slide rail assembly 28, the third slide rail assembly 30 and the fourth slide rail assembly 32 can include at least two slide rails capable of being shifted with respect to each other in a longitudinal direction. In the embodiment, the longitudinal direction can be defined as X-axis direction, or can be interpreted as a lengthwise direction or a shifting direction of the slide rail; a transverse direction can be defined as Y-axis direction, or can be interpreted as a lateral direction of the slide rail; a vertical direction can be defined as Z-axis direction, or can be interpreted as a height direction of the slide rail.

It should be mentioned that the first slide rail assembly 26, the second slide rail assembly 28, the third slide rail assembly 30 and the fourth slide rail assembly 32 can be designed as a pair of two slide rails and respectively mounted on the left side and the right side of the corresponding drawer; however, parts of the foresaid pair of two slide rails, such as the first slide rail assembly 26, the second slide rail assembly 28, the third slide rail assembly 30 and the fourth slide rail assembly 32, are shown in FIG. 2 and FIG. 3 for easy understanding of the embodiment.

The cabinet 22 can include a plurality of walls, such as first lateral wall 34, a second lateral wall 36, and a middle wall (which is named as the wall 38 in the following description). The wall 38 can be located between the first lateral wall 34 and the second lateral wall 36. The cabinet 22 can have a first space K1 located between the first lateral wall 34 and the wall 38 and configured to accommodate the first drawer 24*a* and the third drawer 24*c*, and further have a second space K2 located between the second lateral wall 36 and the wall 38 and configured to accommodate the second drawer 24*b* and the fourth drawer 24*d*. The wall 38 can have a first side S1 and a second side S2 opposite to each other.

Figure 4:
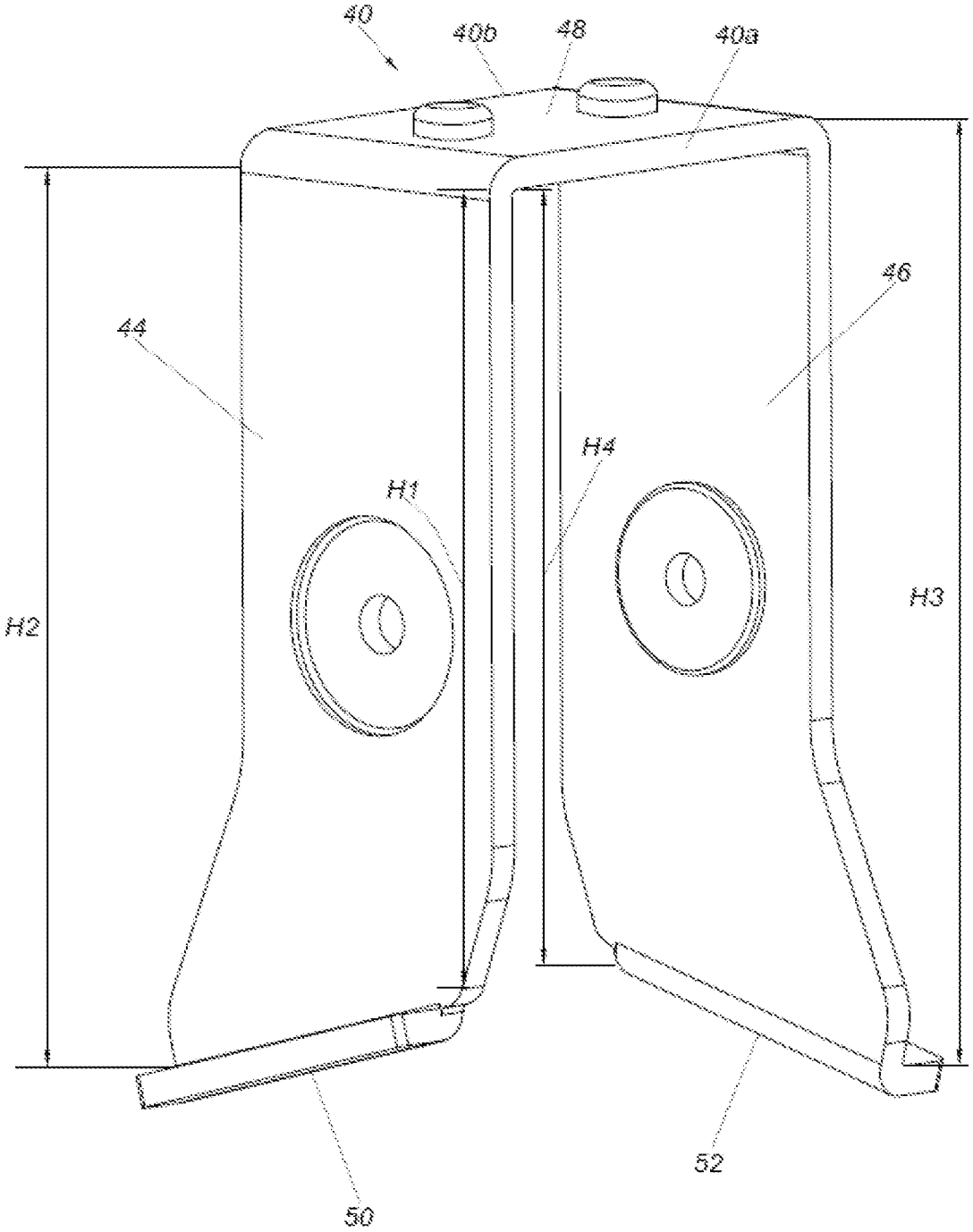
FIG. 4 is a diagram of a working member according to the embodiment of the present application.

Please refer to FIG. 2 to FIG. 4. The slide rail mechanism can further include a working member 40 movably mounted on the wall 38. In the embodiment, the working member 40 can be connected to the wall 38 via a connection member 42; connection between the working member 40 and the wall 38 is not limited to the foresaid embodiment and depends on a design demand. In other possible embodiments, the working member 40 may be connected to the wall 38 via any rotatable or pivotable structural members. Besides, the working member 40 can be preferably located on the top of the wall 38 of the cabinet 22 and near to the front end of the cabinet 22; position of the working member 40 is not limited to the foresaid embodiment and depends on the design demand.

Preferably, the working member 40 can include a first portion 44 and a second portion 46, and preferably further include a middle portion 48. The middle portion 48 can be connected between the first portion 44 and the second portion 46, and be arranged across the wall 38 in the transverse direction.

Preferably, the first portion 44 and the second portion 46 can be respectively bent from two opposite sides of the middle portion 48, such as bending from the sides of the middle portion 48 to ninety degrees. An actual value of the included angle between the middle portion 48 and each of the first portion 44 and the second portion 46 can depend on the design demand.

Preferably, the first portion 44 of the working member 40 can have a first guiding surface 50, and the second portion 46 of the working member 40 can have a second guiding surface 52 (which can be shown in FIG. 4).

Preferably, as shown in FIG. 4, the working member 40 can have a first end 40*a* (such as the front end) and a second end 40*b* (such as the rear end). The first end 40*a* of the first portion 44 of the working member 40 can have a first height H1. The second end 40*b* of the first portion 44 of the working member 40 can have a second height H2. The second height H2 can be greater than the first height H1. The first guiding surface 50 can be formed due to height difference between the first height H1 and the second height H2. In addition, the first end 40*a* of the second portion 46 of the working member 40 can have a third height H3, and the second end 40*b* of the second portion 46 of the working member 40 can have a fourth height H4. The second guiding surface 52 can be formed due to height difference between the third height H3 and the fourth height H4.

Please refer to FIG. 5 to FIG. 8. The first slide rail assembly 26 and the third slide rail assembly 30 can be arranged on the first side S1 of the wall 38, which means the first slide rail assembly 26 and the third slide rail assembly 30 are arranged on the same side of the wall 38 (which can be shown in FIG. 5 and FIG. 6). The second slide rail assembly 28 and the fourth slide rail assembly 32 can be arranged on the second side S2 of the wall 38 (which can be shown in FIG. 7 and FIG. 8).

Moreover, the first slide rail assembly 26 can include a first rail 54 and a second rail 56. The second rail 56 can be shifted with respect to the first rail 54 in the longitudinal direction (which can be shown in FIG. 5 and FIG. 6). The second slide rail assembly 28 can include a third rail 58 and a fourth rail 60. The fourth rail 60 can be shifted with respect to the third rail 58 in the longitudinal direction (which can be shown in FIG. 7 and FIG. 8).

Figure 5:
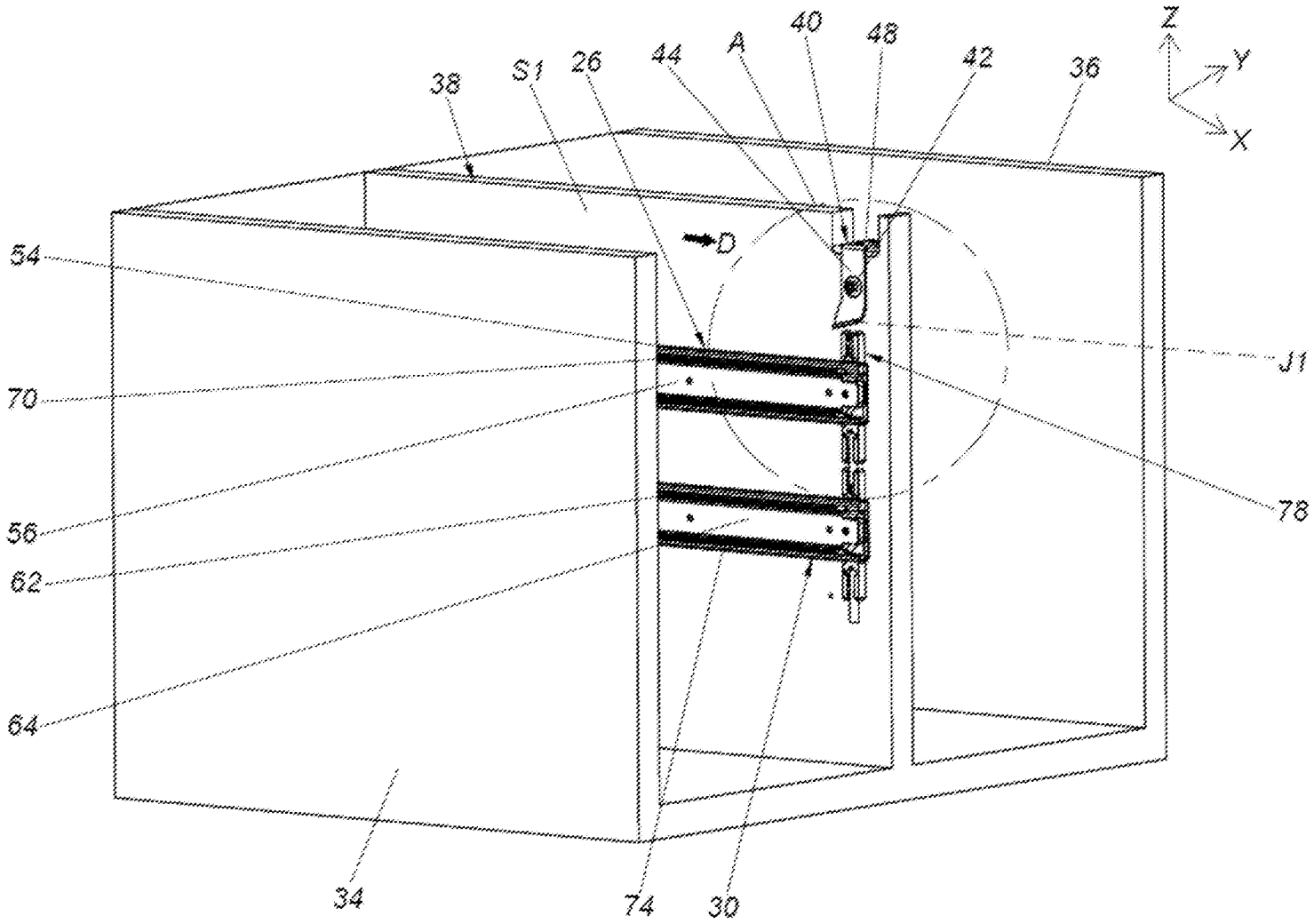
FIG. 5 is a diagram of the plurality of slide rail assemblies arranged on the first side of the wall of the cabinet being in a retracted mode according to the embodiment of the present application.

A predefined height can be existed between the third slide rail assembly 30 and the first slide rail assembly 26, such as the Z-axis direction shown in FIG. 5. The third slide rail assembly 30 can include a fifth rail 62 and a sixth rail 64, and the sixth rail 64 can be shifted with respect to the fifth rail 62 in the longitudinal direction (which can be shown in FIG. 5). The fourth slide rail assembly 32 can include a seventh rail 66 and an eighth rail 68. The eighth rail 68 can be shifted with respect to the seventh rail 66 in the longitudinal direction (which can be shown in FIG. 7).

Figure 6:
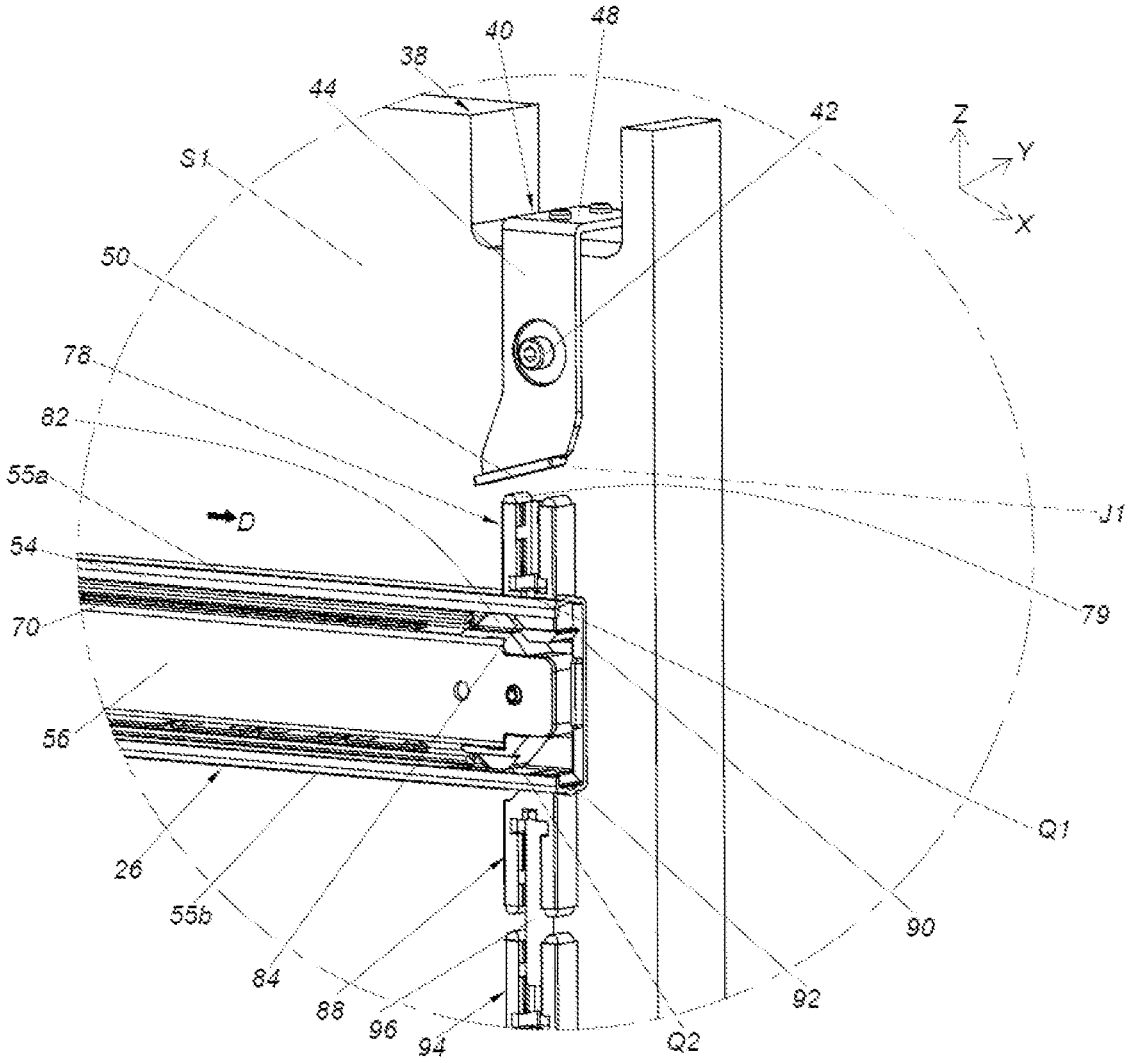
FIG. 6 is an enlarged diagram of an area A shown in FIG. 5.

Preferably, the first rail 54 of the first slide rail assembly 26 and the fifth rail 62 of the third slide rail assembly 30 can be mounted on (such as in a fixed manner) the first side S1 of the wall 38 (which can be shown in FIG. 5 and FIG. 6). The third rail 58 of the second slide rail assembly 28 and the seventh rail 66 of the fourth slide rail assembly 32 can be mounted on (such as in the fixed manner) the second side S2 of the wall 38 in the fixed manner (which can be shown in FIG. 7 and FIG. 8).

Preferably, each of the first slide rail assembly 26, the second slide rail assembly 28, the third slide rail assembly 30 and the fourth slide rail assembly 32 can include a middle rail. For example, the middle rail 70 of the first slide rail assembly 26 can be movably mounted between the first rail 54 and the second rail 56, the middle rail 72 of the second slide rail assembly 28 can be movably mounted between the third rail 58 and the fourth rail 60, the middle rail 74 of the third slide rail assembly 30 can be movably mounted between the fifth rail 62 and the sixth rail 64, and the middle rail 76 of the fourth slide rail assembly 32 can be movably mounted between the seventh rail 66 and the eighth rail 68.

Preferably, the second rail 56 of the first slide rail assembly 26, the fourth rail 60 of the second slide rail assembly 28, the sixth rail 64 of the third slide rail assembly 30 and the eighth rail 68 of the fourth slide rail assembly 32 can be respectively configured to hold the first drawer 24*a*, the second drawer 24*b*, the third drawer 24*c* and the fourth drawer 24*d* as mentioned above.

The second rail 56 can be moved back into the first rail 54 of the first slide rail assembly 26, and the fourth rail 60 can be moved back into the third rail 58 of the second slide rail assembly 28. The sixth rail 64 can be moved back into the fifth rail 62 of the third slide rail assembly 30, and the eighth rail 68 can be moved back into the seventh rail 66 of the fourth slide rail assembly 32.

Figure 9:
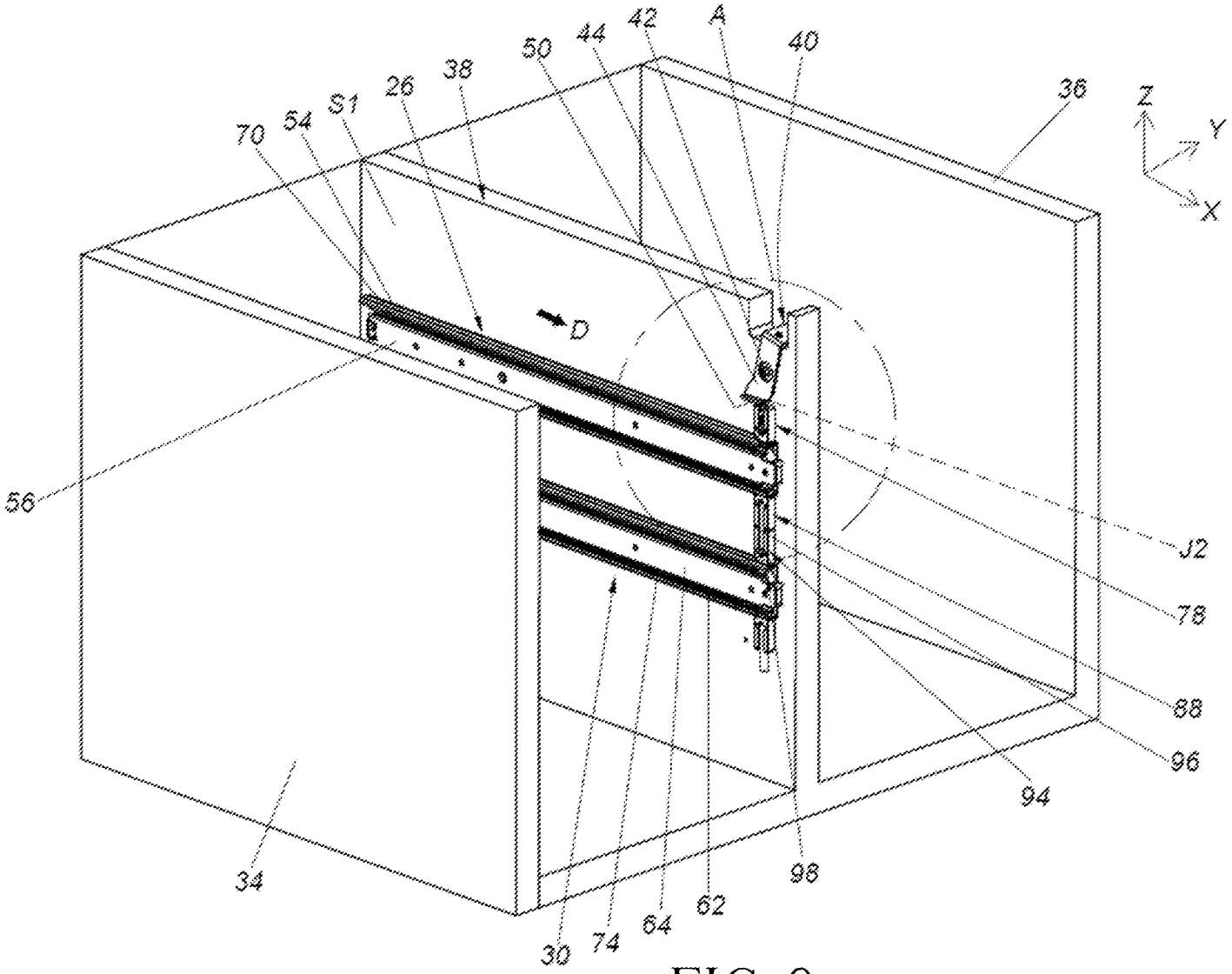
FIG. 9 is a diagram of a second rail of a first slide rail assembly arranged on the first side of the wall of the cabinet being shiftable with respect to a first rail, and a third slide rail assembly arranged on the first side of the wall of the cabinet being in the retracted mode according to the embodiment of the present application.
Figure 10:
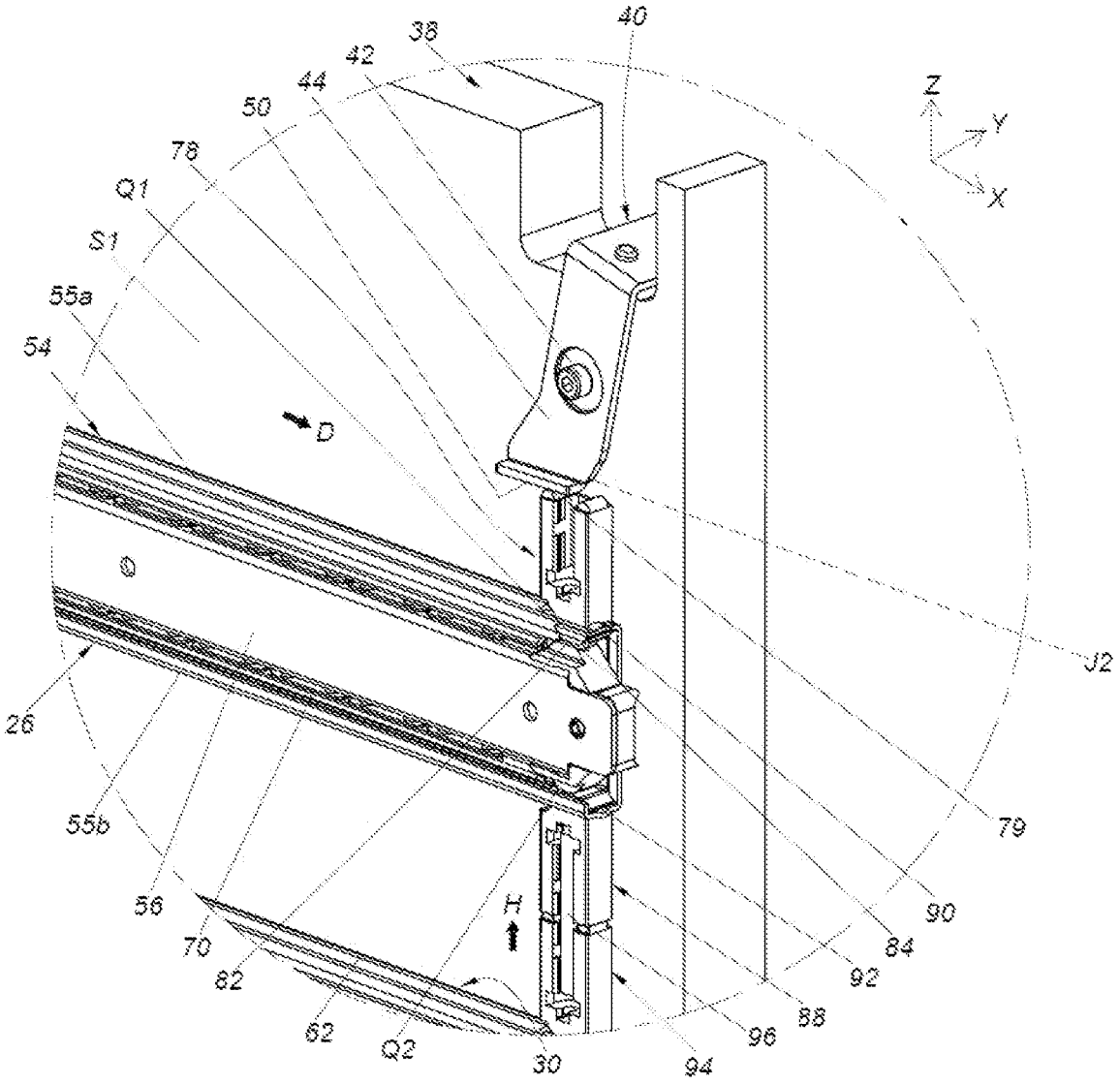
FIG. 10 is an enlarged diagram of the area A shown in FIG. 9.
Figure 11:
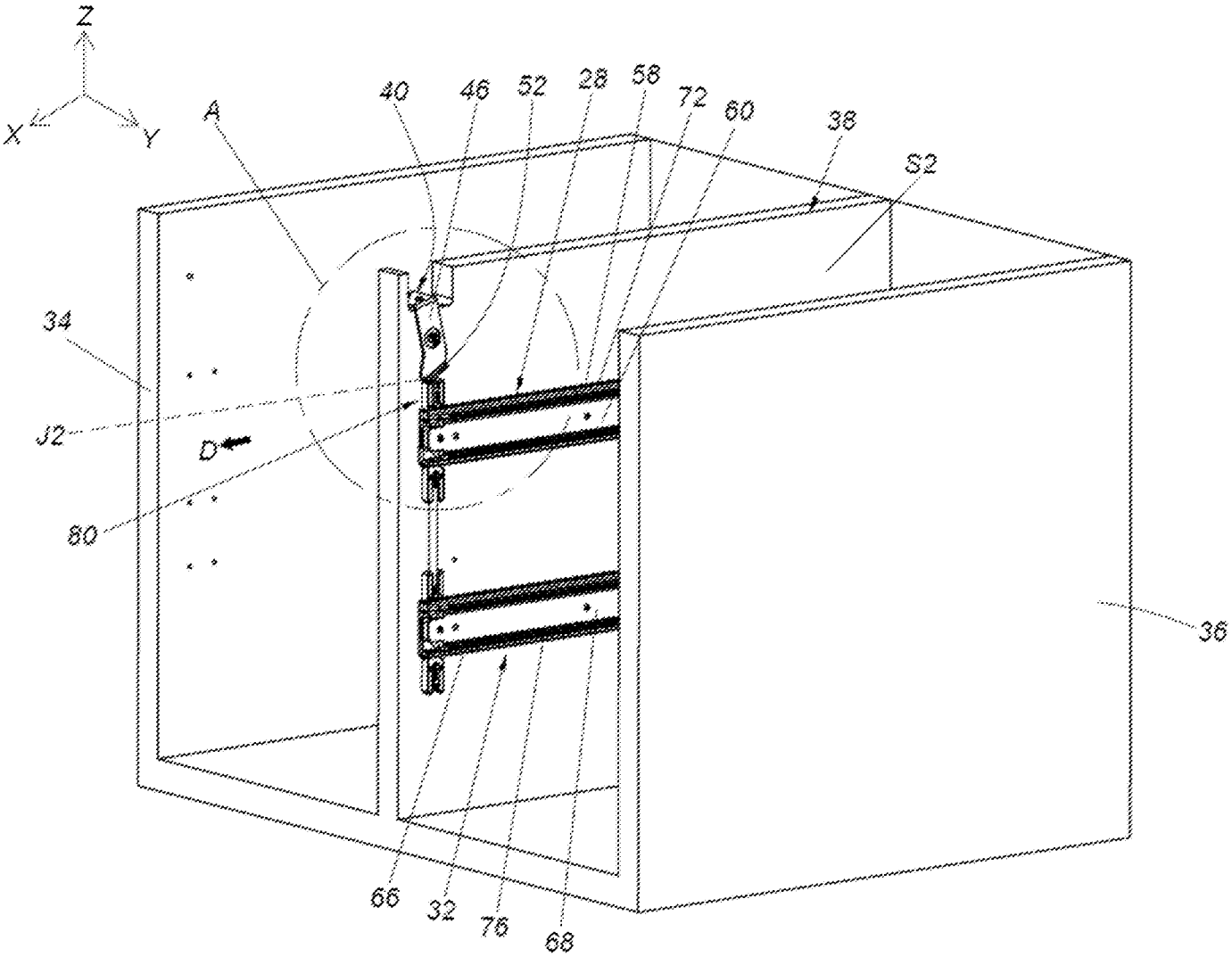
FIG. 11 is a diagram of a second slide rail assembly and a fourth slide rail assembly arranged on the second side of the wall of the cabinet being in the retracted mode according to the embodiment of the present application.
Figure 12:
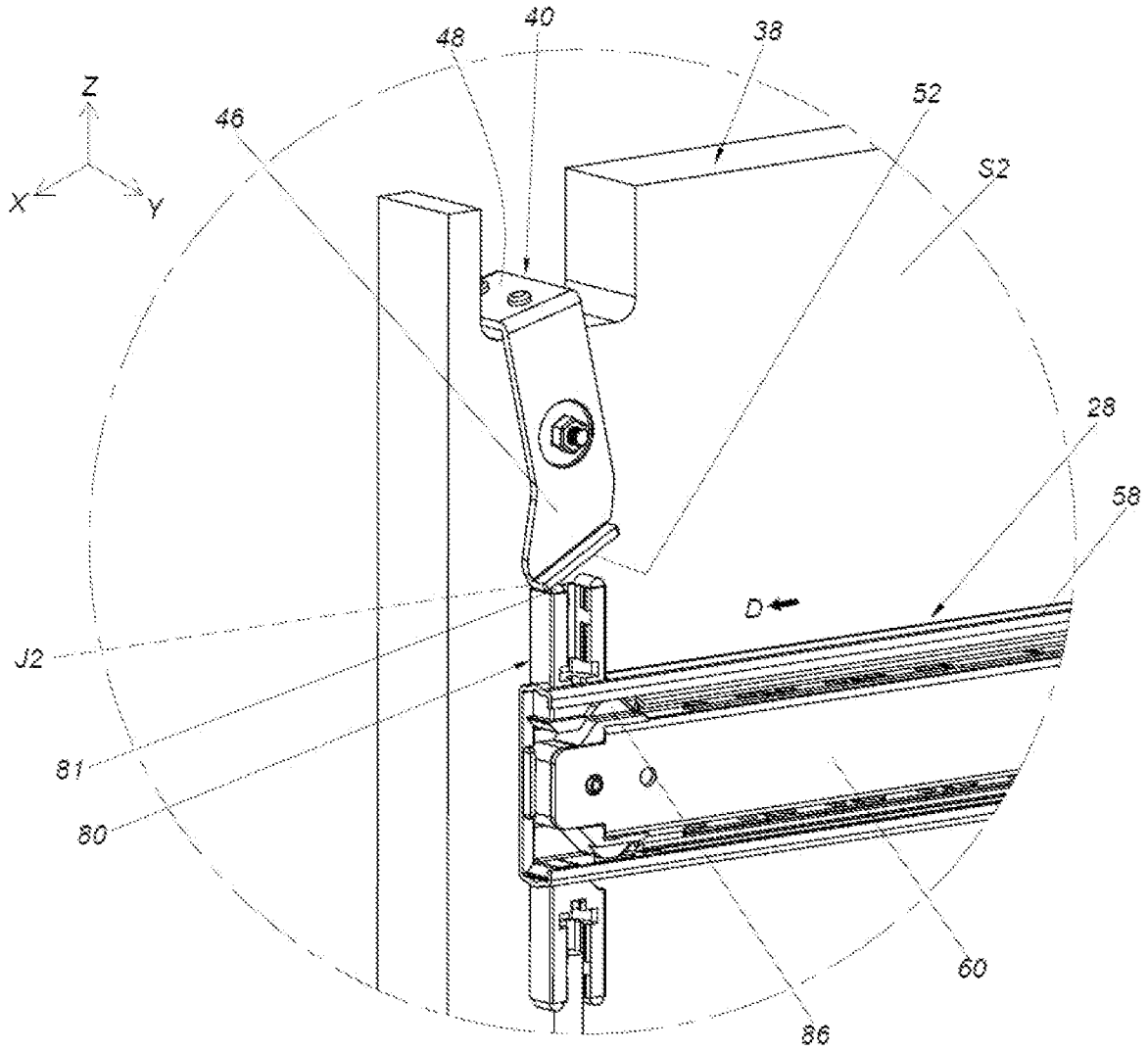
FIG. 12 is an enlarged diagram of the area A shown in FIG. 11.

As shown in FIG. 5 to FIG. 8 and further shown in FIG. 9 to FIG. 12, when the second rail 56 is shifted with respect to the first rail 54 of the first slide rail assembly 26 from a retracted position (such as the embodiment shown in FIG. 5 and FIG. 6) in an actuation direction D, the second rail 56 can drive the working member 40 to switch from a first mode J1 (such as the embodiment shown in FIG. 5 to FIG. 8) to a second mode J2 (such as the embodiment shown in FIG. 9 to FIG. 12) in a pivotable manner or in a swayed manner, so as to prevent the fourth rail 60 of the second slide rail assembly 28 from being shifted with respect to the third rail 58 in the actuation direction D (such as the embodiment shown in FIG. 11 and FIG. 12).

Figure 8:
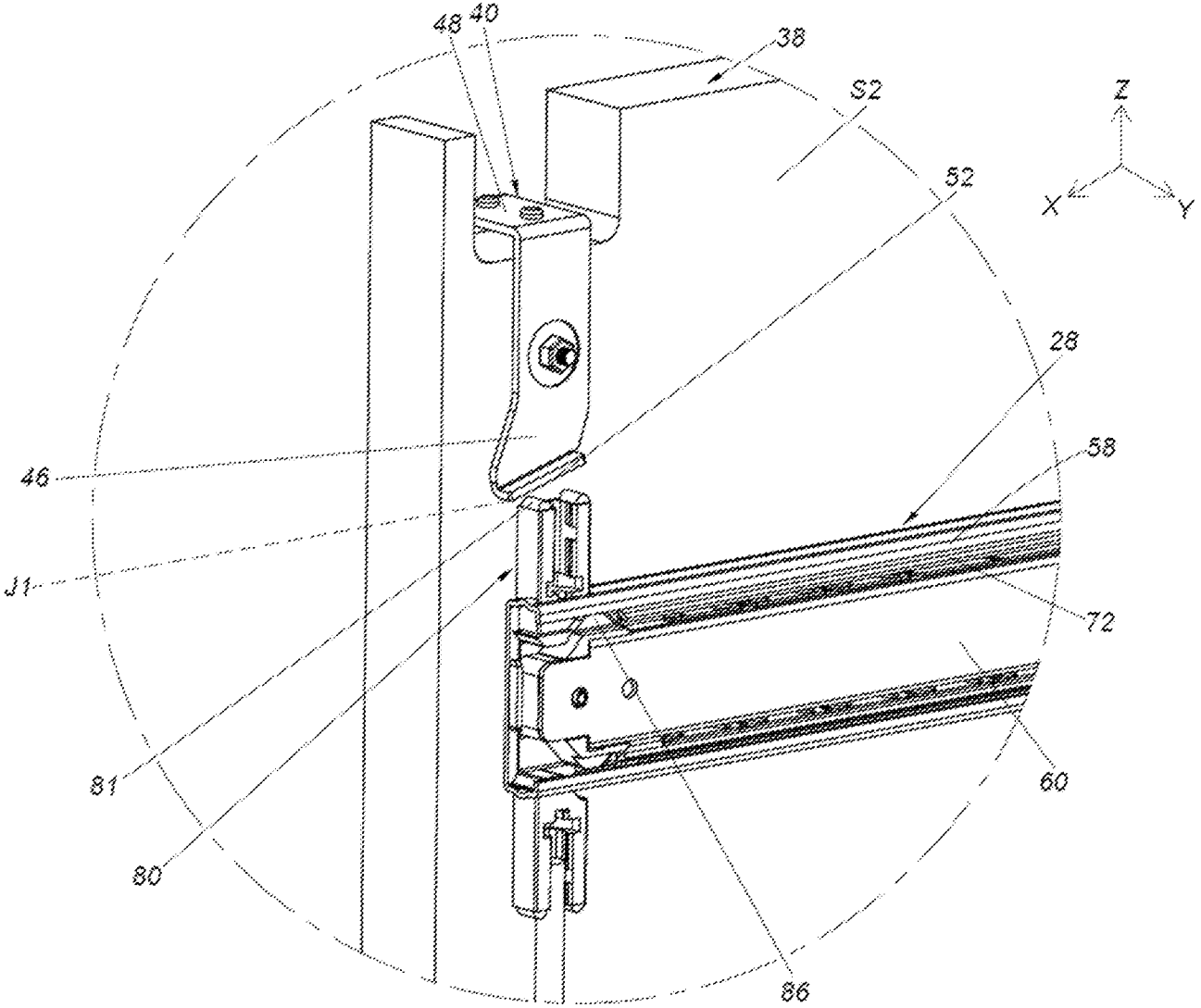
FIG. 8 is an enlarged diagram of the area A shown in FIG. 7.

Preferably, the first slide rail assembly 26 can further include first driving member 78 movably mounted on the first rail 54 (such as the embodiment shown in FIG. 5 and FIG. 6 or the embodiment shown in FIG. 9 and FIG. 10). The first rail 54 can include a first wall 55*a* (such as an upper wall) and a second wall 55*b* (such as lower wall). The first wall 55*a* can have a first hole Q1 where through the first driving member 78 is passed. The first driving member 78 of the first slide rail assembly 26 can include at least one first guiding structure 79 (which can be shown in FIG. 6 or FIG. 10), and the at least one first guiding structure 79 can be an arc surface or an inclined surface. Similarly, the second slide rail assembly 28 can further include a first driving member 80 movably mounted on the third rail 58 (such as the embodiment shown in FIG. 7 and FIG. 8 or the embodiment shown in FIG. 11 and FIG. 12). The first driving member 80 of the second slide rail assembly 28 can include at least one first guiding structure 81 (which can be shown in FIG. 8 or FIG. 12), and the at least one first guiding structure 81 can be the arc surface or the inclined surface.

When the second rail 56 is shifted with respect to the first rail 54 of the first slide rail assembly 26 in the actuation direction D, the second rail 56 can drive the first driving member 78 of the first slide rail assembly 26 to abut against the first portion 44 of the working member 40 (which can be shown in FIG. 6 and FIG. 10), so as to switch the working member 40 from the first mode J1 (which can be shown in FIG. 6) to the second mode J2 (which can be shown in FIG. 10); therefore, the first driving member 80 of the second slide rail assembly 28 can be blocked by the second portion 46 of the working member 40 (which can be shown in FIG. 11 and FIG. 12), and the fourth rail 60 can be blocked by the first driving member 80 of the second slide rail assembly 28, so as to prevent the fourth rail 60 of the second slide rail assembly 28 from being shifted with respect to the third rail 58 in the actuation direction D (which can be shown in FIG. 11 and FIG. 12).

Figure 7:
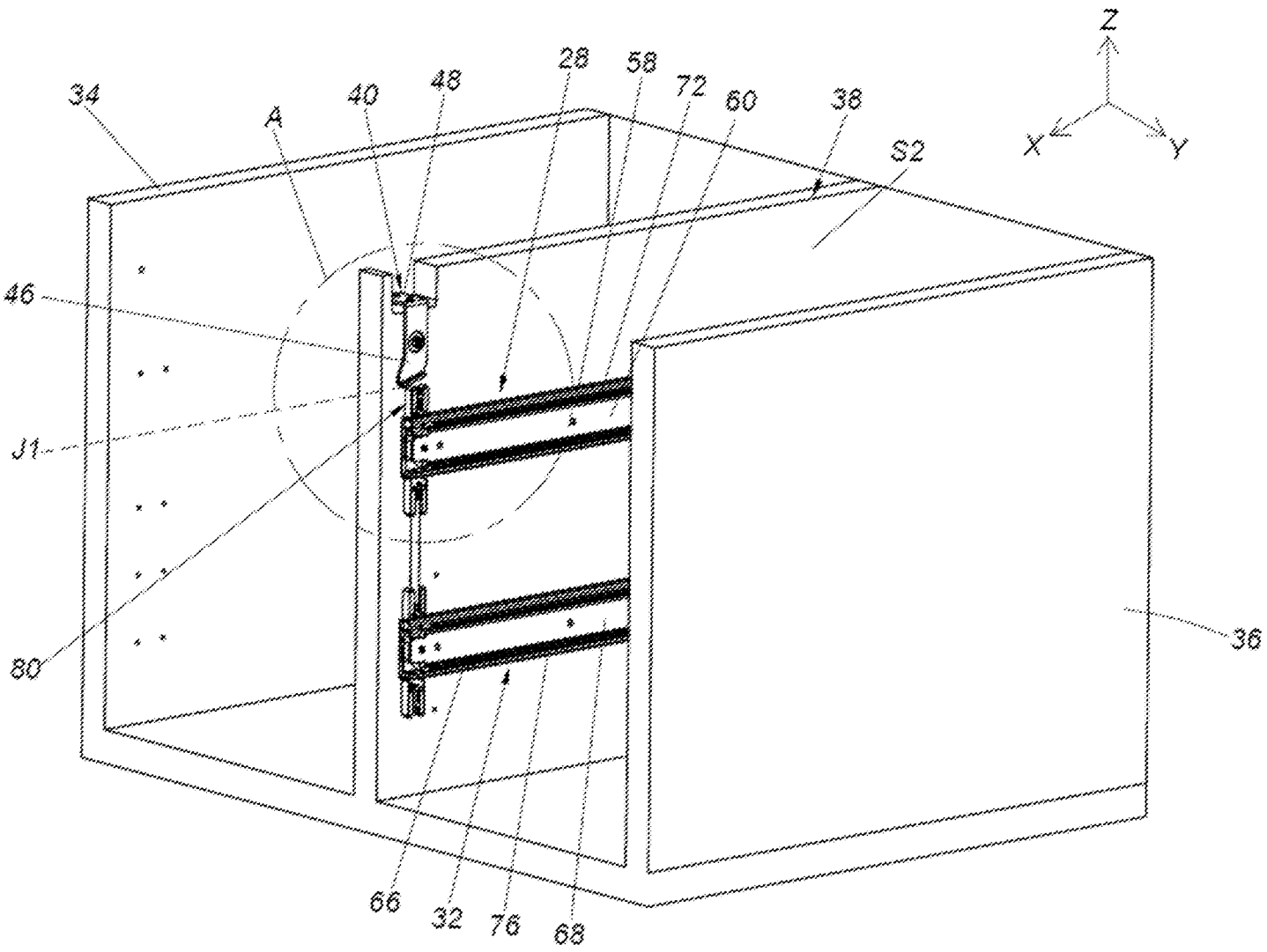
FIG. 7 is a diagram of the plurality of slide rail assemblies arranged on the second side of the wall of the cabinet being in the retracted mode according to the embodiment of the present application.

Preferably, the second rail 56 can include a first driving feature 82, and the first driving feature 82 can include a guiding portion 84 (which can be shown in FIG. 6 and FIG. 10), and the fourth rail 60 can include a first driving feature 86 (which can be shown in FIG. 8 and FIG. 12); the first portion 44 of the working member 40 can be located on the first side S1 of the wall 38 (such as the embodiment shown in FIG. 5 and FIG. 6 or the embodiment shown in FIG. 9 and FIG. 10), and the second portion 46 of the working member 40 can be located on the second side S2 of the wall 38 (such as the embodiment shown in FIG. 7 and FIG. 8 or the embodiment shown in FIG. 11 and FIG. 12).

When the second rail 56 of the first slide rail assembly 26 is shifted with respect to the first rail 54 from the retracted position in the actuation direction D, the first driving feature 82 (or the related guiding portion 84) of the second rail 56 can drive the first driving member 78 of the first slide rail assembly 26 (which can be shown in FIG. 10), and the first guiding structure 79 of the first driving member 78 of the first slide rail assembly 26 can abut against the first guiding surface 50 of the first portion 44 of the working member 40 (which can be shown in FIG. 10), so as to switch the working member 40 from the first mode J1 (which can be shown in FIG. 5 to FIG. 8) to the second mode J2 (which can be shown in FIG. 9 to FIG. 12); therefore, the first driving member 80 of the second slide rail assembly 28 can be blocked by the second guiding surface 52 of the second portion 46 of the working member 40 (which can be shown in FIG. 11 and FIG. 12), and the first driving feature 86 of the fourth rail 60 can be blocked by the first driving member 80 of the second slide rail assembly 28 (which can be shown in FIG. 12), so as to prevent the fourth rail 60 of the second slide rail assembly 28 from being shifted with respect to the third rail 58 in the actuation direction D (which can be shown in FIG. 11 and FIG. 12).

Preferably, the first slide rail assembly 26 can further include a second driving member 88 movably mounted on the first rail 54; for example, the second wall 55*b* of the first rail 54 can have a second hole Q2 where through the second driving member 88 is passed. Besides, the first driving member 78 and the second driving member 88 of the first slide rail assembly 26 can respectively include a first constraining portion 90 and a second constraining portion 92. The first constraining portion 90 can abut against an inner surface of the first wall 55*a* of the first rail 54, and the second constraining portion 92 can abut against an inner surface of the second wall 55*b* of the first rail 54, so that the first driving member 78 and the second driving member 88 of the first slide rail assembly 26 can be moved with respect to the first rail 54 to an extreme position (which can be shown in FIG. 9 and FIG. 10). Similarly, the third slide rail assembly 30 can further include a first driving member 94 movably mounted on the fifth rail 62. Structural configuration of the first driving member 94 and the fifth rail 62 of the third slide rail assembly 30 can be substantially the same as structural configuration of the first driving member 78 and the first rail 54 of the first slide rail assembly 26, and a detailed description is omitted herein for simplicity. Further, a rod member 96 can be arranged between the second driving member 88 of the first slide rail assembly 26 and the first driving member 94 of the third slide rail assembly 30 (which can be shown in FIG. 9 and FIG. 10); for example, the rod member 96 can be connected between the second driving member 88 of the first slide rail assembly 26 and the first driving member 94 of the third slide rail assembly 30.

When the second rail 56 of the first slide rail assembly 26 is shifted with respect to the first rail 54 in the actuation direction D, the slide rail mechanism of the present application can utilize a linkage mechanism to block the sixth rail 64 and therefore to prevent the sixth rail 64 of the third slide rail assembly 30 from being shifted with respect to the fifth rail 62 in the actuation direction D. In one possible embodiment, a configuration direction of the linkage mechanism can be substantially the same as a height direction H of the wall 38. The linkage mechanism can include the second driving member 88 of the first slide rail assembly 26, the first driving member 94 of the third slide rail assembly 30, and the rod member 96.

Moreover, when the second rail 56 of the first slide rail assembly 26 is shifted with respect to the first rail 54 in the actuation direction D, the second driving member 88 of the first slide rail assembly 26 can be blocked by the second rail 56 (or the middle rail 70) of the first slide rail assembly 26, so that the second driving member 88 of the first slide rail assembly 26 cannot be moved in the height direction H, and a first driving feature 98 of the sixth rail 64 can be blocked by the first driving member 94 of the third slide rail assembly 30, so as to prevent the sixth rail 64 of the third slide rail assembly 30 from being shifted with respect to the fifth rail 62 in the actuation direction D (which can be shown in FIG. 9 and FIG. 10). The structural configuration of the first driving feature 98 of the sixth rail 64 can be substantially the same as the structural configuration of the first driving feature 82 of the first rail 56, or substantially the same as the structural configuration of the first driving feature 86 of the fourth rail 60, and the detailed description is omitted herein for simplicity.

Therefore, the slide rail mechanism in the embodiment of the present application can provide following features:

1. when the second rail 56 (and the related first drawer 24*a*) of the first slide rail assembly 26 arranged on the first side S1 of the wall 38 of the cabinet 22 is pulled out with respect to the first rail 54 (or the related cabinet 22), the working member 40 can be utilized to prevent the fourth rail 60 (and the related second drawer 24*b*) of the second slide rail assembly 28 arranged on the second side S2 of the wall 38 of the cabinet 22 from being pulled out with respect to the third rail 58 (or the related cabinet 22), so that the slide rail mechanism can lock the adjacent drawer in the transverse direction or in the lateral direction.
2. preferably, when the second rail 56 (and the related first drawer 24*a*) of the first slide rail assembly 26 arranged on the first side S1 of the wall 38 of the cabinet 22 is pulled out with respect to the first rail 54 (or the related cabinet 22), the working member 40 can be utilized to prevent the sixth rail 64 (and the related third drawer 24) of the third slide rail assembly 30 arranged on the first side S1 of the wall 38 of the cabinet 22 from being pulled out with respect to the fifth rail 62 (or the related cabinet 22), so that the slide rail mechanism can lock the adjacent drawer in the height direction or in the vertical direction.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail mechanism configured to a cabinet, the cabinet having a wall with a first side and a second side opposite to each other, the slide rail mechanism comprising:

a first slide rail assembly arranged on the first side of the wall, the first slide rail assembly comprising a first rail and a second rail, and the second rail being shiftable with respect to the first rail in a longitudinal direction;

a second slide rail assembly arranged on the second side of the wall, the second slide rail assembly comprising a third rail and a fourth rail, and the fourth rail being shifted with respect to the third rail in the longitudinal direction;

a working member movably mounted on the wall;

wherein the second rail is configured to move back into the first rail of the first slide rail assembly, and the fourth rail is configured to move back into the third rail of the second slide rail assembly;

wherein the first slide rail assembly further comprises a first driving member movably mounted on the first rail, the second slide rail assembly further comprises a first driving member movably mounted on the third rail, the working member comprises a first portion and a second portion, when the second rail is shifted with respect to the first rail of the first slide rail assembly in an actuation direction, the second rail drives the first driving member of the first slide rail assembly to abut against the first portion of the working member for switching the working member from a first mode to a second mode, so that the first driving member of the second slide rail assembly is blocked by the second portion of the working member, and the fourth rail is blocked by the first driving member of the second slide rail assembly, so as to prevent the fourth rail from being shifted with respect to the third rail of the second slide rail assembly in the actuation direction.

2. The slide rail mechanism of claim 1, wherein the second rail comprises a first driving feature, and the fourth rail comprises a first driving feature; the first portion of the working member is located on the first side of the wall, and the second portion of the working member is located on the second side of the wall; when the second rail is shifted with respect to the first rail of the first slide rail assembly in the actuation direction, the first driving feature of the second rail drives the first driving member of the first slide rail assembly to abut against the first portion of the working member for switching the working member from the first mode to the second mode, so that the first driving member of the second slide rail assembly is blocked by the second portion of the working member, and the first driving feature of the fourth rail is blocked by the first driving member of the second slide rail assembly, so as to prevent the fourth rail from being shifted with respect to the third rail of the second slide rail assembly in the actuation direction.

3. The slide rail mechanism of claim 1, wherein the working member further comprise a middle portion connected between the first portion and the second portion, and the middle portion is arranged across the wall in a transverse direction.

4. The slide rail mechanism of claim 1, wherein the first portion of the working member has a first guiding surface, and the second portion of the working member has a second guiding surface.

5. The slide rail mechanism of claim 1, wherein the working member is connected to the wall via a connection member.

6. The slide rail mechanism of claim 1, wherein the slide rail mechanism further comprises a third slide rail assembly arranged on the first side of the wall, a predefined height is existed between the third slide rail assembly and the first slide rail assembly, the third slide rail assembly comprises a fifth rail and a sixth rail, and the sixth rail is shifted with respect to the fifth rail in the longitudinal direction.

7. The slide rail mechanism of claim 6, wherein the first slide rail assembly further comprises a second driving member movably mounted on the first rail, the third slide rail assembly further comprises a first driving member movably mounted on the fifth rail, and a rod member is arranged between the second driving member of the first slide rail assembly and the first driving member of the third slide rail assembly; when the second rail is shifted with respect to the first rail of the first slide rail assembly in the actuation direction, the second driving member of the first slide rail assembly is blocked by the second rail of the first slide rail assembly, and a first driving feature of the sixth rail is blocked by the first driving member of the third slide rail assembly, so as to prevent the sixth rail of the third slide rail assembly from being shifted with respect to the fifth rail in the actuation direction.

8. The slide rail mechanism of claim 1, wherein the first slide rail assembly further comprises a middle rail movably mounted between the first rail and the second rail, and the second slide rail assembly further comprises a middle rail movably mounted between the third rail and the fourth rail.

9. The slide rail mechanism of claim 6, wherein the second rail of the first slide rail assembly is configured to hold a first drawer, the fourth rail of the second slide rail assembly is configured to hold a second drawer, and the sixth rail of the third slide rail assembly is configured to hold a third drawer.

10. A slide rail mechanism configured to a wall with a first side and a second side opposite to each other, the slide rail mechanism comprising:

a first slide rail assembly arranged on the first side of the wall, the first slide rail assembly comprising a first rail and a second rail, and the second rail being shifted with respect to the first rail in a longitudinal direction;

a second slide rail assembly arranged on the second side of the wall, the second slide rail assembly comprising a third rail and a fourth rail, and the fourth rail being shifted with respect to the third rail in the longitudinal direction;

a working member movably mounted on the wall;

wherein when the second rail is shifted with respect to the first rail of the first slide rail assembly in an actuation direction, the working member is driven by the second rail to switch from a first mode to a second mode, so as to prevent the fourth rail from being shifted with respect to the third rail of the second slide rail assembly in the actuation direction;

wherein the slide rail mechanism further comprises a third slide rail assembly arranged on the first side of the wall, the third slide rail assembly comprises a fifth rail and a sixth rail, and the sixth rail is shifted with respect to the fifth rail in the longitudinal direction;

wherein when the second rail is shifted with respect to the first rail of the first slide rail assembly in the actuation direction, the sixth rail is blocked by a linkage mechanism to prevent the sixth rail from being shifted with respect to the fifth rail of the third slide rail assembly in the actuation direction;

wherein the first slide rail assembly further comprises a first driving member movably mounted on the first rail, the second slide rail assembly further comprises a first driving member movably mounted on the third rail, the working member comprises a first portion and a second portion, when the second rail is shifted with respect to the first rail of the first slide rail assembly in the actuation direction, the second rail drives the first driving member of the first slide rail assembly to abut against the first portion of the working member for switching the working member from the first mode to the second mode, so that the first driving member of the second slide rail assembly is blocked by the second portion of the working member, and the fourth rail is blocked by the first driving member of the second slide rail assembly, so as to prevent the fourth rail of the second slide rail assembly from being shifted with respect to the third rail in the actuation direction.

11. The slide rail mechanism of claim 10, wherein the working member further comprise a middle portion connected between the first portion and the second portion, and the middle portion is arranged across the wall in a transverse direction.

12. The slide rail mechanism of claim 10, wherein the first portion of the working member has a first guiding surface, and the second portion of the working member has a second guiding surface.

13. The slide rail mechanism of claim 10, wherein an arrangement direction of the linkage mechanism is substantially the same as a height direction of the wall, the linkage mechanism comprises two driving members and a rod member, the rod member is arranged between the two driving members; one of the two driving members is movably mounted on the first rail of the first slide rail assembly, and the other driving member of the two driving members is movably mounted on the fifth rail of the third slide rail assembly.

* * * * *